US005758788A

United States Patent [19]

Lifshey

[11] Patent Number: 5,758,788

[45] Date of Patent: Jun. 2, 1998

[54] PIERCING CONTAINER CAP

[75] Inventor: Arthur L. Lifshey, East Brunswick, N.J.

[73] Assignee: Merck & Co., Inc., Rahway, N.J.

[21] Appl. No.: 729,974

[22] Filed: Oct. 15, 1996

Related U.S. Application Data

[60] Provisional application No. 60/007,007, Oct. 25, 1995.

[51] Int. Cl. [6] ..... B65D 51/22

[52] U.S. Cl. ..... 215/278; 215/208; 215/303; 220/255; 220/278

[58] Field of Search ..... 215/247, 45, 44, 215/48, 204, 208, 226, 228, 230, 277, 278, 302, 303, 320, 321, 329, 330, 331, 354, DIG. 3; 220/225, 256, 258, 281, 377, 278; 222/83, 562; 206/459.5, 459.1, 828

[56] References Cited

U.S. PATENT DOCUMENTS

| | | |
|---|---|---|
| 3,425,598 | 2/1969 | Kobernick . |
| 3,923,184 | 12/1975 | Choksi et al. . |
| 4,111,322 | 9/1978 | Obrist et al. . |
| 4,389,802 | 6/1983 | McLaren et al. . |
| 4,723,687 | 2/1988 | Kutterer . |
| 5,020,690 | 6/1991 | Kishikawa et al. . |
| 5,027,979 | 7/1991 | Kawajiri et al. . |

*Primary Examiner*—Allan N. Shoap
*Assistant Examiner*—Nathan Newhouse
*Attorney, Agent, or Firm*—Elliott Korsen; Mark R. Daniel

[57] ABSTRACT

A closure device for containers comprising a cap having a piercing member, the cap moving first downward and then upward relative to a container to which it is affixed, when first rotated in the direction used to open the container, the piercing member capable of causing rupture of a seal on the container during the downward motion and the upward motion resulting in removal of the cap.

2 Claims, 4 Drawing Sheets

PIERCING CONTAINER CAP

BACKGROUND OF THE INVENTION

This invention relates to a container cap which contains a piercing member. The cap being designed to move first downward and then upward relative to the container to which it is affixed, when it is first rotated in the direction expected to result in removal of the cap. The downward motion allows the piercing member to contact a seal or cover on the container causing the seal or cover to rupture. The upward motion allows for removal of the cap.

Often, containers are encountered which have, in addition to a screw cap, a seal or film over the opening which is designed to provide security from tampering, reduce bacterial infection or otherwise protect the product. Commonly these include sealed containers for medicine, glue and the like where a plastic container top is actually sealed closed during the molding process. Other examples include containers which contain tablets, dry ingredients, oil, or the like, where a foil or plastic film is sealed across the top of the container after the contents have been placed inside. These seals must be punctured or ruptured to gain access to the contents of the container.

Various devices have been proposed to open such seals and films. Several include puncturing devices located in the center of the cap. These allow for forced screwing of the cap onto the container to allow a piercing member to break the seal. Others rely on a piercing member which is located on the top of the cap. Here the cap is removed from the container, inverted 180 degrees and then a piercing member is pressed onto the seal to effect rupture. Still other devices such as a "can opener" or "spike" are available which are separate from the cap and which can be used to open these sealed containers.

These devices are often cumbersome and require a great degree of manual dexterity. Many are inoperable by those who cannot provide enough pressure to cause the rupture of the seal or film.

The container cap presented here avoids the problems associated with the devices discussed by providing a means for first moving the cap in a downward direction relative to the container so that a piercing means within the cap can rupture the seal. Once the downward motion has reached its desired maximum, continued rotation in the same direction results in moving the cap in an upward direction for removal. One of the unique features of this container cap is that the cap is only rotated in one direction, the direction the user expects to effect removal.

SUMMARY OF THE INVENTION

A container cap assembly is presented which comprises a cap and a locking sheath the assembly having means for first directing the travel of the cap in a downward direction relative to a container to which the container cap is attached, means for attaching the locking sheath to the cap and means for directing the travel of the cap in an upward direction relative to the container to which the container cap is attached, wherein upon rotation in a manner expected to result in removal of the cap assembly from a container to which it is attached, the cap moves first in a downward directive relative to the container and then in an upward direction relative to the container, the upward direction resulting in removal of the cap from the container. The cap may contain a piercing member which is designed to rupture a seal on the top of the container to which the cap assembly is attached.

BRIEF DESCRIPTION OF THE DRAWINGS

FIG. 3 consists of four views of the cap.

DETAILED DESCRIPTION OF THE INVENTION

A container cap assembly is presented which comprises a cap and a locking sheath the assembly having means for first directing the travel of the cap in a downward direction relative to a container to which the container cap is attached, means for attaching the locking sheath to the cap and means for directing the travel of the cap in an upward direction relative to the container to which the container cap is attached, wherein upon rotation in a manner expected to result in removal of the cap assembly from a container to which it is attached, the cap moves first in a downward directive relative to the container and then in an upward direction relative to the container, the upward direction resulting in removal of the cap from the container.

One embodiment of the invention includes the container cap assembly which comprises a cap having an inner locking sheath, the cap having a top plate having an inside and outside, and a side wall which is symmetrical about a longitudinal axis and joined to the top plate, the side wall enclosing the inside of the top plate, the cap having upper and lower ramp followers and a storage groove; the inner locking sheath having a side wall which is symmetrical about a longitudinal axis, the side wall having an inside and outside surface, the inside surface of the inner locking sheath having screw threads, the screw threads being matable to the threads of a container for which the cap is intended, the screw threads being directed so as to allow for removal of the cap when the container is rotated in a particular direction; the outside surface of the inner locking sheath having an upper ramp and lower ramp directed to guide the cap along a downward path when the cap is rotated, the upper and lower ramps capable of receiving the upper and lower ramp followers, the locking sheath being held in a fixed position relative to the rotation of the cap until the ramp followers reach the terminus of the ramps; the locking sheath being fixed in position relative to the container by a locking finger which extends from the locking sheath and is inserted into a groove located in the top of the container; wherein as the cap is rotated in the direction intended to open the container, the cap moves downward relative to the container following the path dictated by the upper and lower ramps until the cap rotates into position over top of the locking finger of the locking sheath, the locking finger then moves from the groove in the container to the storage groove in the cap causing the locking sheath to be permanently affixed to the inside of the cap, continued rotation of the container cap causing the inner locking sheath to rotate with the cap and the assembly moving upward guided by the threads on the locking sheath and container.

Figure 1:
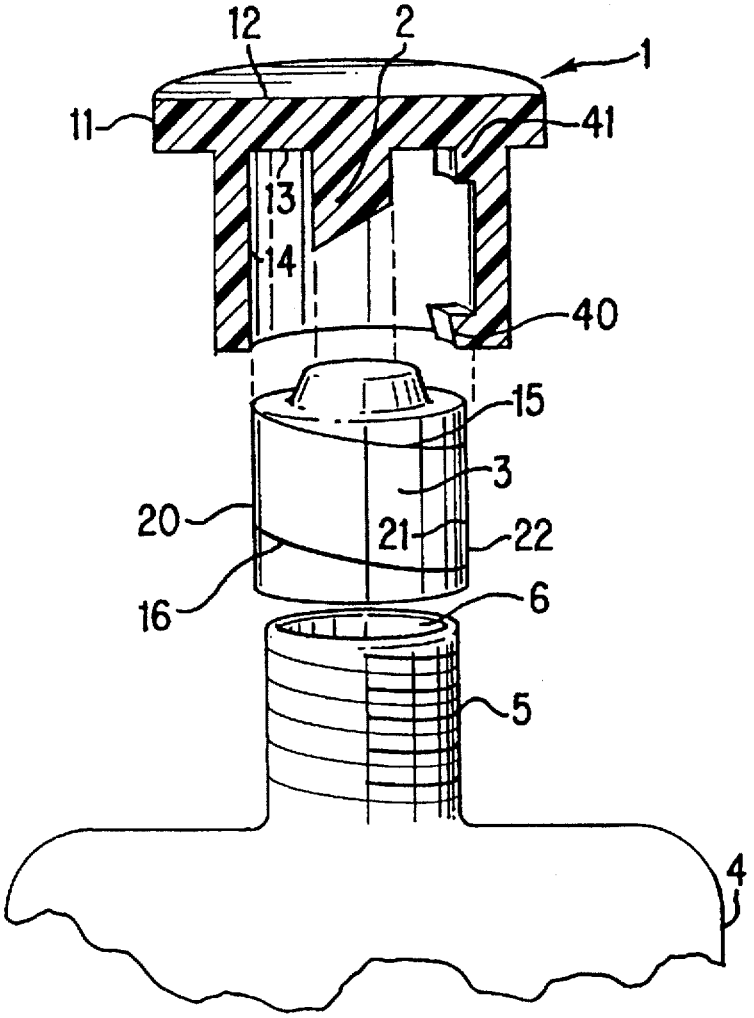
FIG. 1 is a side view of the cap which has a piercing member, an inner locking sheath and the top of a container designed to receive the cap.

The container cap assembly is presented as shown in FIG. 1, which comprises a cap (1) having a piercing member (2) and a locking sheath (3), the cap (1) moving first downward and then upward relative to the container (4) when first rotated in the direction used to open the container. A piercing member (2) capable of rupturing a seal (6) on the container during the downward motion may be provided.

By container cap is meant any covering, stopper, plug or other closing device that could be applied to a container to close off an ingress or egress from the container and which may be removed as desired to provide for such ingress or egress.

By "cap" is meant a covering for the container cap assembly which may be gripped and rotated. The cap in the instant device may have one or more "piercing members" which protrudes from inside the cap down towards the opening of the cap. The piercing member is designed to rupture a cover or film protection on a container to which the container cap assembly is affixed.

The cap may have certain features such as screw threads or cam followers which allow it to follow a path dictated by suitable threads or cams on the outside of the of locking sheath. The cap may also contain locking means which when actuated, cause the locking sheath to mate with the cap such that the locking sheath is affixed to the cap.

Before the locking means and locking sheath interact, the cap is rotatable about the outside of the locking sheath with limited resistance, through a predetermined angular displacement which comprises the angle of actuation. By "angle of actuation" is meant the number of degrees which the cap moves through, before the locking sheath attaches and the cap begins to move upward relative to the container to which it is affixed. The locking sheath is designed to reside inside the cap once the cap travels to the maximum downward position during the initial opening rotation.

The locking sheath is in the general shape of a cylinder. The cylinder has an inside surface and an outside surface. The locking sheath has screw threads on its inside surface which mate with the screw threads on the container upon which the container cap is to be used. The locking sheath is held stationary during the downward motion of the cap upon initial rotation of the cap. The locking sheath may be held in place manually or mechanical means may be provided to hold the locking sheath in place while the cap is first rotated and moves in its downward path. Means for holding the locking sheath in place are known to those in the art of container and cap manufacture and include mechanical means which link with the container until being released. These mechanical means include the use of pins, biasing devices, adhesives, welding the locking sheath to the container in such a way that rotation of the cap eventually breaks the weld loose, and other method known to those in the art.

The locking sheath also contains locking means for mating the locking sheath to the cap so that once the cap has rotated and moves in the required downward distance relative to the container to which it is affixed, the locking sheath and cap may lock together and move as one unit. Such locking means include the use of an appendage affixed to the locking sheath which is biased in such a manner that it moves into a gap in the cap and locks when the gap is rotated into a position opposite the appendage. Other methods of mating the locking sheath to the cap such as manual insertion of a pin, friction fitting and others are known in the art and are included with the scope of this invention.

Figure 2:
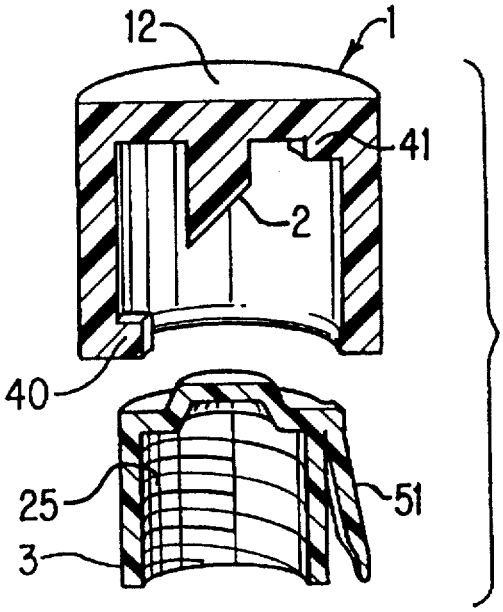
FIG. 2 is a cut-away view along a center line through the cap, the inner locking sheath and the top of the container which shows one embodiment of the invention.
Figure 3A:
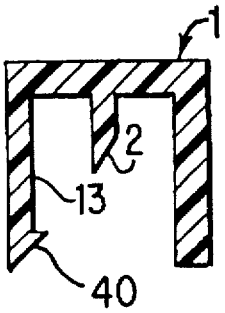
FIG. 3*a* is a cut-away view of the cap showing the piercing member and lower cam follower.
Figure 3B:
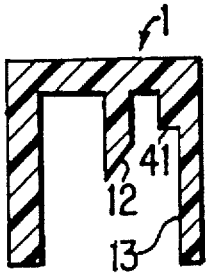
FIG. 3*b* is a cut-away view of the cap showing the upper cam follower.
Figure 3C:
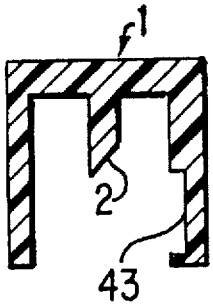
FIG. 3*c* is a cut-away view of the cap showing the locking means.
Figure 3D:
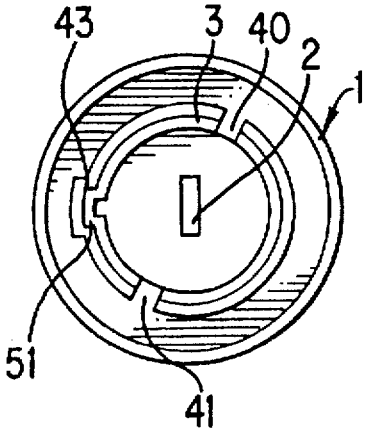
FIG. 3*d* is a top view of the cap.

FIG. 1 shows one preferred embodiment of the instant invention. In this embodiment, the container cap assembly comprises a cap (1) having a piercing member (2), and an inner locking sheath (3). The cap has a top plate (11) having an inside (13) and outside (12), and a side wall (14) which is symmetrical about a longitudinal axis and joined to the top plate (11) enclosing the inside of the top plate (11). A piercing member (2) is affixed to the inside (13) of the top plate (11). An inner locking sheath (3) has a side wall (20) which is symmetrical about a longitudinal axis, the side wall (20) having an inside (21) and outside (22) surface, the inside surface (21) of the inner locking sheath (3) having screw threads (25) which are shown in FIG. 2. The screw threads (25) are constructed to mate with the threads (5) of a container (4) for which the container cap assembly is intended. The screw threads on the inside surface (25) of the locking sheath (3) are directed so as to allow for removal of the container cap assembly when the container is rotated in a particular direction. In the embodiment shown in FIG. 1, the outside surface of the inner locking sheath has an upper ramp(15) and lower ramp (16) to guide the cap (1) along a downward path while the locking sheath (3) is held in a fixed position relative to the rotation of the cap (1). The locking sheath (3) is fixed in position relative to the container (4) by a locking finger (51) which extends from the locking sheath (3) and is inserted into a locking means (43) in the top of the receiver slot (52). As the cap (1) is rotated in the direction needed to open the container (4), the cap (1) moves downward relative to the container (4) as it follows along the path dictated by the ramps (15) and (16). Once the cap (1) rotation has proceeded a predetermined angular displacement relative to the surface of the inner locking sheath (3), which is also known as the "angle of activation", that distance being determined by the length of the ramps (15) and (16), the locking finger (51) of the locking sheath (3) moves from the groove in the receiver slot (52) to a locking means (43) in the cap (1) causing the locking sheath (3) to be permanently affixed to the inside of the cap (1). Continued rotation of the cap (1) causes the inner locking sheath (3) to rotate with the cap and the cap-locking sheath assembly moves upwards guided by the threads on the locking sheath (3) and container (4)

When rupture of a protective seal or film (6) is desired, the cap (1) functions as follows, upon rotation of the cap (1) in a direction which would be expected to cause the cap (1) to move away from the container (4), the cap (1) follows ramps (15) and (16) located on the locking sheath (3) and closes further on the container (4). This downward motion of the cap (1) allows the piercing member (2) to cut through a protective seal or film (6). Protective seal or film (6) is for example a seal or membrane affixed to the top of the container (4) or in some instances it may be a molded section of a container (4) which is thin or brittle enough to be ruptured by the pressure exerted by the piercing member (2). As the cap (1) is further rotated in the direction expected to remove it from the container (4), the locking means of the cap (1) engages the inner locking sheath (3) and the inner locking sheath (3) and cap (1) are mated. Further rotation of the cap (1) and inner locking sheath member causes engagement of the threads (3) of the inner surface of the inner locking sheath (3) so that the cap-locking sheath assembly, operating as a single unit, move in a direction away from the container (4) and can be removed.

Three cross-sectional views of a preferred embodiment of the cap portion of the invention are shown in FIG. 3. Each view is rotated to show a specific feature of the cap (1). FIG. 3(*a*) shows the cap (1) with the piercing member (2) and at the lower portions of the inside wall of the cap (13) a lower cam follower (40) is shown. In FIG. 3(*b*) the upper cam follower (41) is shown. In FIG. 3(*c*) one example of a locking means (43) is shown. FIG. 3(*d*) shows all of these features in a plane view of the cap (1).

Figure 4:
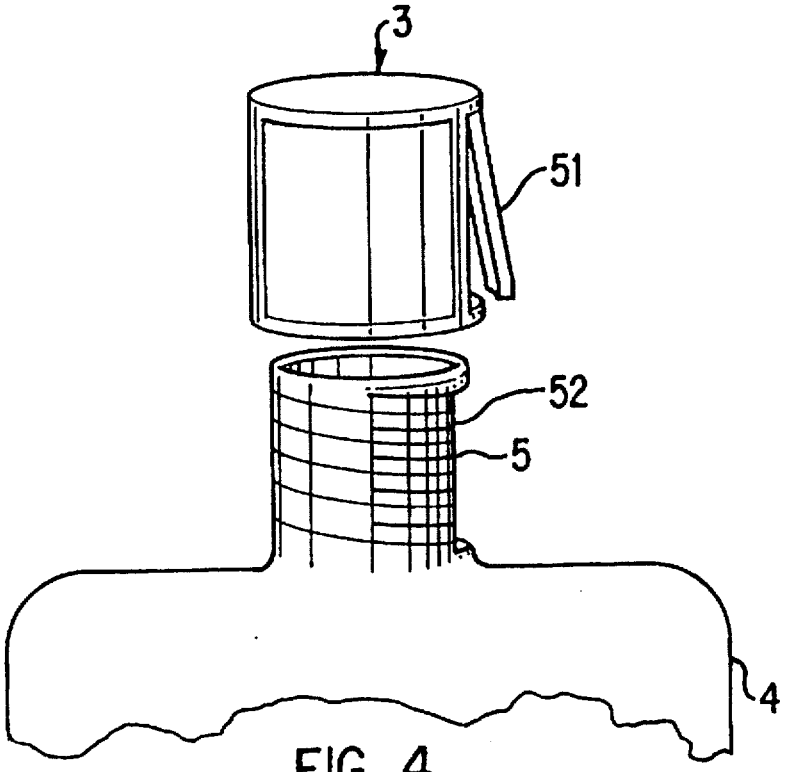
FIG. 4 is a side view of the inner locking sheath and the top of the container to which it would ultimately be attached.

Similarly a cross-sectional view of a preferred embodiment of the locking sheath is shown in FIG. 4. This view shows a locking finger (51) which is designed to have a springing action and spring away from the center of the locking sheath. The neck of a container (4) designed to receive locking finger (51) in the receiver slot (52) is also shown in FIG. 4. Locking finger (51) is held in the receiver slot by the walls of the cap until the locking means (43), as shown in FIG. 3, of the cap (1) are fully exposed and the locking finger (51) moves into the cap, joining the cap and the locking sheath (3). The locking finger (51) may be biased in such a manner as to promote movement out of the container receiver slot (52) and into the cap locking means (43) to assure that a positive lock is realized.

The preferred embodiment of this invention functions as follows. Initially, the locking sheath (3) is screwed or pushed down over the neck of the container. The locking appendage is aligned with and fits into the receiver slot (52) on the neck of the container. Next the cap is pushed over the locking sheath into a position where the locking means (43), as shown in FIG. 3, avoids the locking finger (51) and the upper cam followers (41) and lower cam followers (40) are locked into their respective initial angular position on the cams on the locking sheath (3). The cap (1) is now in position and ready to be opened.

To pierce the protective cover on the container, the cap is rotated in the direction that would normally cause the cap to move up the threads and away from the container. However, since the cap is able to rotate while the locking sheath stays stationary, the cap follows the cams located on the locking sheath and moves downward relative to the top of the container and the piercing means ruptures the protective cover on the container. Once the end of the cam is reached, the cam followers meet with the edge of the locking sheath and the locking appendage matches up with and moves into the locking means in the cap. This results in a permanent and secure mating of the cap and locking sheath and the cap and locking sheath rotate as one unit. Continued rotation in the same direction causes the cap to move upward and away from the top of the container so that the container cap can be unscrewed and removed from the container in the normal manner.

The cap and locking sheath, once connected, can be reused as a single unit. Once reinstalled, the cap and locking sheath unit behaves in a manner similar to a normal cap. That is, rotation in a manner that would be expected to remove the cap results in movement away from the top of the container only.

In another preferred embodiment of this invention, the ramps or cams on the locking sheath are replaced with screw threads located on the outside surface of the locking sheath. The outside surface screw threads are aligned in the direction opposite to the threads on the inside of locking sheath. In this embodiment, screw threads which mate to those on the outside of the locking sheath are found on the inside of the side wall of the cap. Initial rotation of the cap in the direction expected to result in removal of the cap causes the cap to move downward relative to the container following the screw threads until the cap reaches the end of the threaded portion. At this point, the locking sheath locks into the cap and continued rotation of the cap results in engagement of the threads on the inside of the locking sheath and ultimate removal of the cap.

The container cap assembly may be of any color desired and may be opaque or clear depending upon the use. For example, a clear, colorless cap may be used if the cap is to be affixed to a container which has a tamper evident seal across the top which is to be ruptured when the cap is first rotated. This would permit inspection of the integrity of the seal by the user before the cap is rotated.

The container cap assembly may also be shaped in any manner desired. That is, it may have additional pieces mounted on the cap which allow for easy opening. Other structural designs which would provide for easy gripping are also contemplated in this invention.

The top or sides of the container cap assembly may by recessed to accept an insert such as a logo, a color code or printing. The top or sides of the container cap assembly may also be constructed so as to receive printed literature such as package inserts for pharmaceutical products.

What is claimed is:

1. A container cap assembly which comprises: a cap having an inner locking sheath, the cap having a top plate having an inside and outside, and a side wall which is symmetrical about a longitudinal axis and joined to the top plate, the side wall enclosing the inside of the top plate, the cap having upper and lower ramp followers and a storage groove; the inner locking sheath having a side wall which is symmetrical about a longitudinal axis, the side wall having an inside and outside surface, the inside surface of the inner locking sheath having screw threads, the screw threads being matable to the threads of a container for which the cap is intended, the screw threads being directed so as to allow for removal of the cap when the container is rotated in a particular direction; the outside surface of the inner locking sheath having an upper ramp and lower ramp directed to guide the cap along a downward path when the cap is rotated, the upper and lower ramps capable of receiving the upper and lower ramp followers, the locking sheath being held in a fixed position relative to the rotation of the cap until the ramp followers reach the terminus of the ramps; the locking sheath being fixed in position relative to the container by a locking finger which extends from the locking sheath and is inserted into a groove located in the top of the container; wherein as the cap is rotated in the direction intended to open the container, the cap moves downward relative to the container following the path dictated by the upper and lower ramps until the cap rotates into position over top of the locking finger of the locking sheath, the locking finger then moves from the groove in the container to the storage groove in the cap causing the locking sheath to be affixed to the inside of the cap, continued rotation of the container cap causing the inner locking sheath to rotate with the cap and the assembly moving upward guided by the threads on the locking sheath and container.

2. The container cap assembly of claim 1 wherein the cap contains a piercing member.

* * * * *